US008662198B2

(12) United States Patent
Linley

(10) Patent No.: US 8,662,198 B2
(45) Date of Patent: Mar. 4, 2014

(54) APPARATUS FOR DRIVING PILES OR DRILLING HOLES

(76) Inventor: Jason Linley, Fort St. John (CA)

( * ) Notice: Subject to any disclaimer, the term of this patent is extended or adjusted under 35 U.S.C. 154(b) by 303 days.

(21) Appl. No.: 12/971,091

(22) Filed: Dec. 17, 2010

(65) Prior Publication Data

US 2012/0012354 A1 Jan. 19, 2012

Related U.S. Application Data

(60) Provisional application No. 61/287,453, filed on Dec. 17, 2009.

(51) Int. Cl.
*E02D 7/06* (2006.01)
*E21B 7/02* (2006.01)

(52) U.S. Cl.
USPC ..... 173/185; 173/184; 173/44; 173/164

(58) Field of Classification Search
USPC ..... 173/184, 185, 44, 164
See application file for complete search history.

(56) References Cited

U.S. PATENT DOCUMENTS 3,447,613 A * 6/1969 Lisenby ..... 173/28
3,754,604 A * 8/1973 Inaba et al. ..... 173/28
4,067,398 A * 1/1978 Franzen et al. ..... 173/193
5,012,873 A * 5/1991 Kennedy et al. ..... 173/185
6,896,072 B2 * 5/2005 MacDonald ..... 173/192
7,757,780 B2 * 7/2010 Pollock et al. ..... 173/185
2008/0277131 A1 * 11/2008 Pollock et al. ..... 173/185

OTHER PUBLICATIONS

Rev Drill HDH Series W/ Down Hole Hammer Set-Up. http://sgc-group.com/html/rev-drill.html.
Commercial Drill Rentals and Sales. http://www.revdrill.com.

* cited by examiner

*Primary Examiner* — Michelle Lopez
(74) *Attorney, Agent, or Firm* — Davis & Bujold, PLLC; Michael J. Bujold

(57) ABSTRACT

An apparatus for driving piles or drilling holes includes a self propelled vehicle with a mounting platform supported by the vehicle. A lifting and positioning arm is provided having a mounting end and a remote end. The mounting end is mounted to the platform. The arm rotates about a vertical axis relative to the platform wherein the remote end of the arm is positioned in a selected radial orientation relative to the platform. The arm pivots about a substantially horizontal axis relative to the platform wherein the arm is moved up and down to position the remote end of the arm at a selected height above or below the platform. The arm extends and retracts wherein the remote end of the arm is positioned a selected distance from the platform. A pile driver or drill assembly is pivotally mounted to the remote end of the arm.

5 Claims, 11 Drawing Sheets

APPARATUS FOR DRIVING PILES OR DRILLING HOLES

FIELD

There is illustrated and described an apparatus that can be used for driving piles or drilling holes.

BACKGROUND

As a general rule, pile driving apparatus are unable to drive piles, above grade, below grade, at an angle or when confronted by an obstacle. There is a need for a more versatile pile driving apparatus. Similar problems arise with equipment used for drilling holes.

SUMMARY

There is provided an apparatus for driving piles or drilling holes includes a self propelled vehicle with a mounting platform supported by the vehicle. A lifting and positioning arm is provided having a mounting end and a remote end. The mounting end is mounted to the platform. The arm rotates about a vertical axis relative to the platform wherein the remote end of the arm is positioned in a selected radial orientation relative to the platform. The arm pivots about a substantially horizontal axis relative to the platform wherein the arm is moved up and down to position the remote end of the arm at a selected height above or below the platform. The arm extends and retracts wherein the remote end of the arm is positioned a selected distance from the platform. A pile driver or drill assembly is pivotally mounted to the remote end of the arm.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
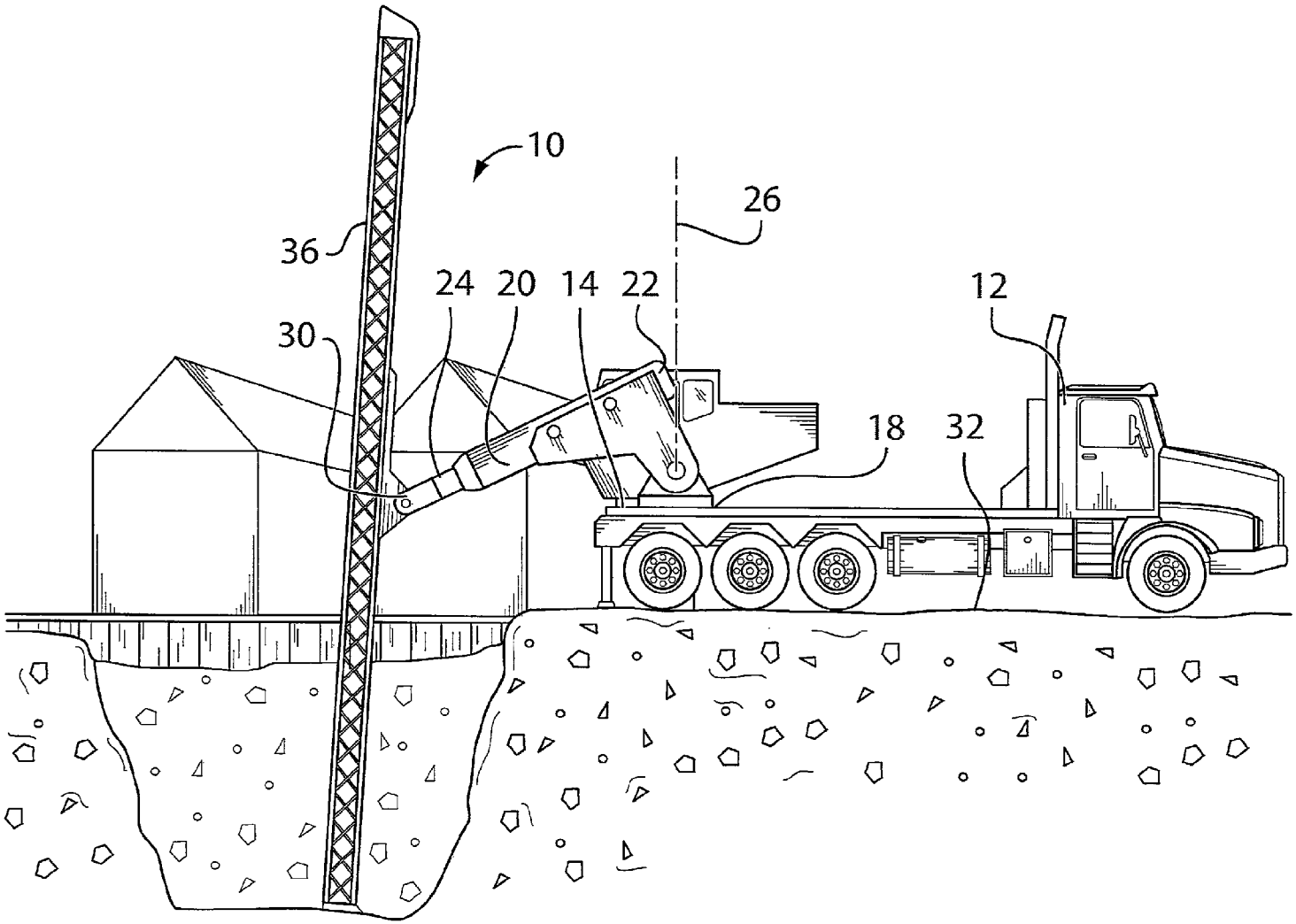
FIG. 1 is a left side elevation view of the apparatus working below grade.
Figure 2:
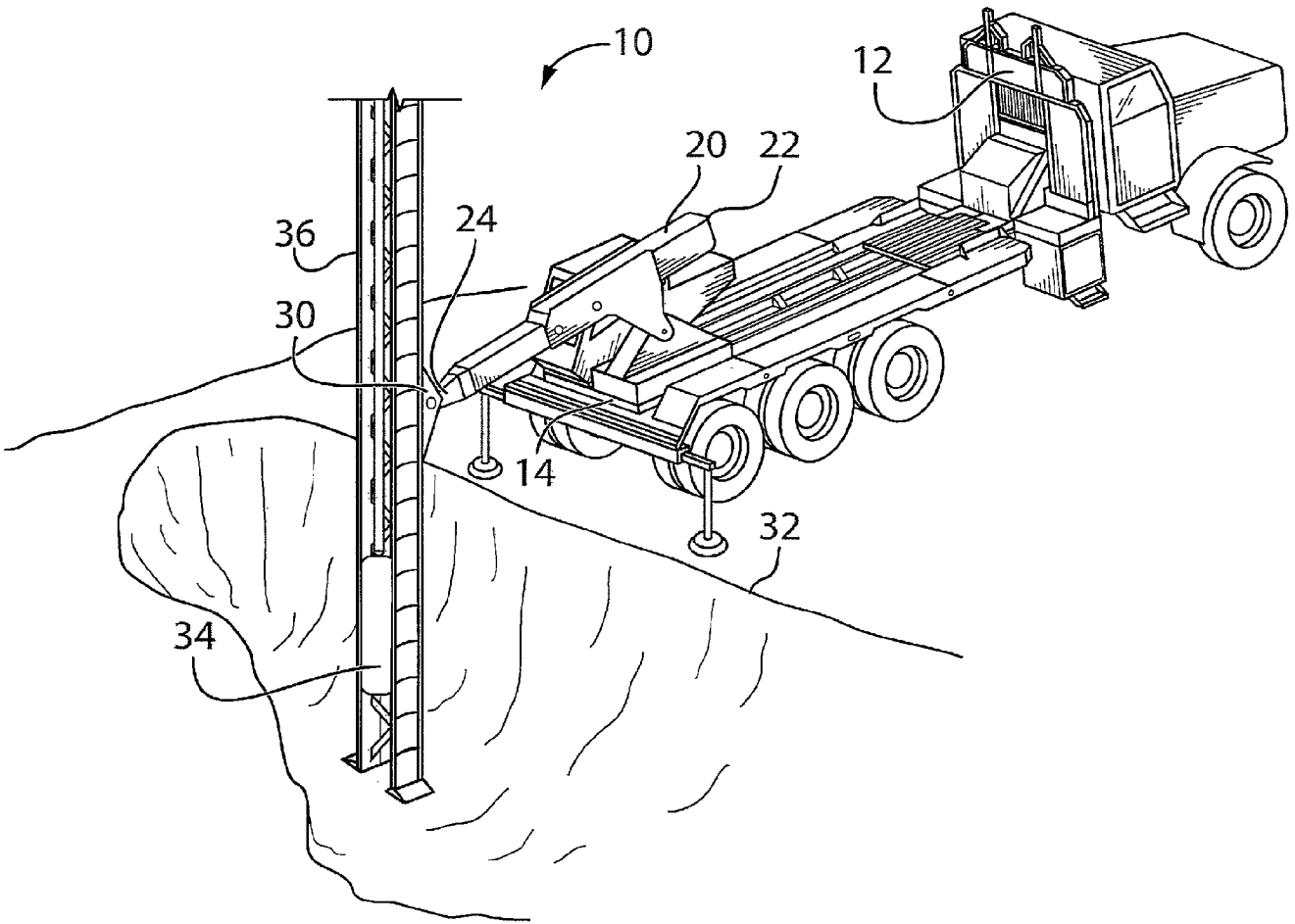
FIG. 2 is a left side/rear perspective view of the apparatus working below grade.

An apparatus for driving piles or drilling holes generally identified by reference numeral 10, will now be described with reference to FIG. 1 through 12. FIG. 1 and FIG. 2 illustrates the apparatus at work below grade. This is something that most pile driving apparatus are incapable of doing.

Now that one of the major advantages of the apparatus has been illustrated, there will now be described the various features that enable this to occur. Referring to FIG. 1, a pile driving application has been selected for the purpose of illustration. It will be apparent that the teachings are also applicable to various other applications listed under variations.

Figure 3:
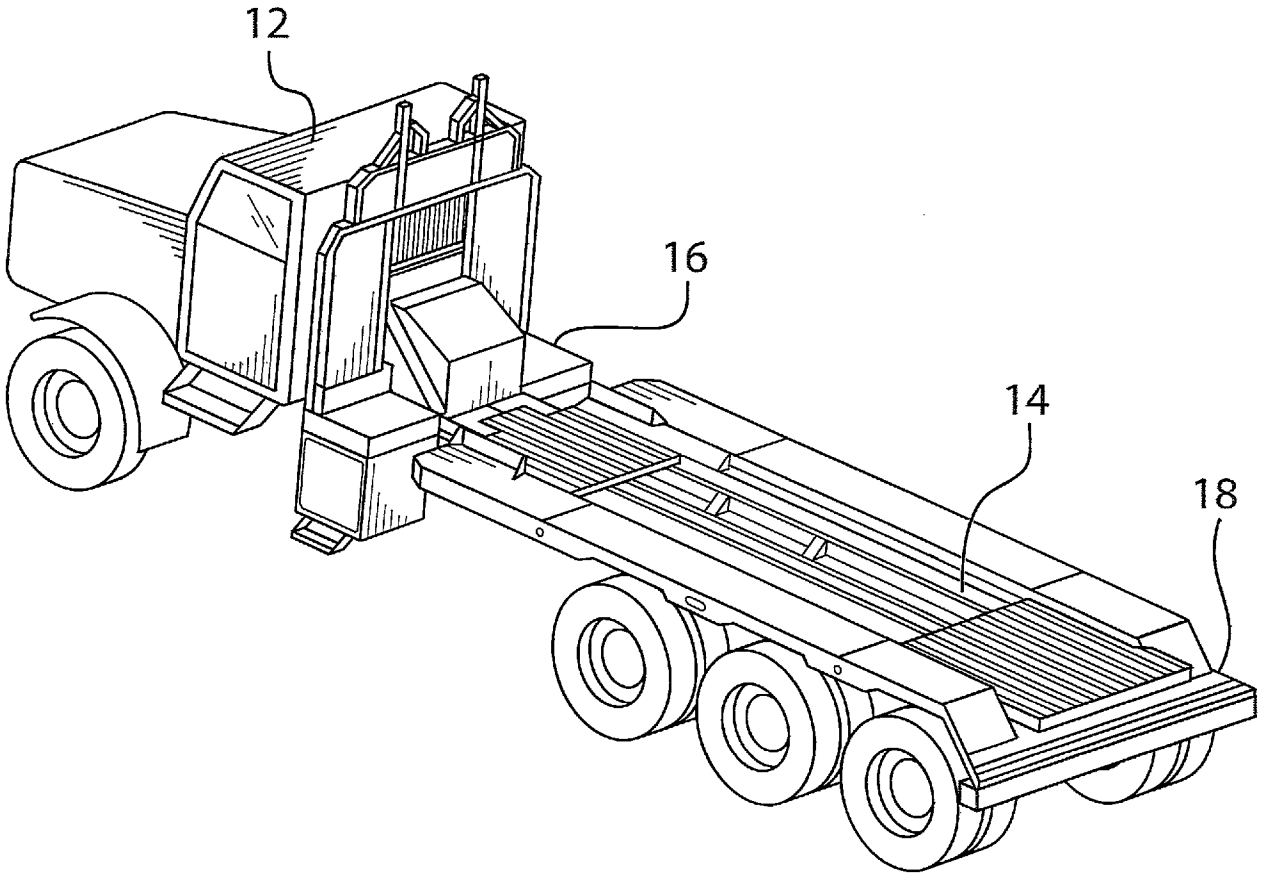
FIG. 3 is a left side/rear perspective view of platform without mounting arm.

As shown in FIG. 3, this pile driving apparatus 10 uses a self-propelled vehicle 12. A mounting platform 14 is supported by vehicle 12. The platform 14 is movable along vehicle 12 wherein platform 14 is selectively positioned on vehicle 12 either toward the front 16, toward the rear 18 or at positions in between.

Figure 4:
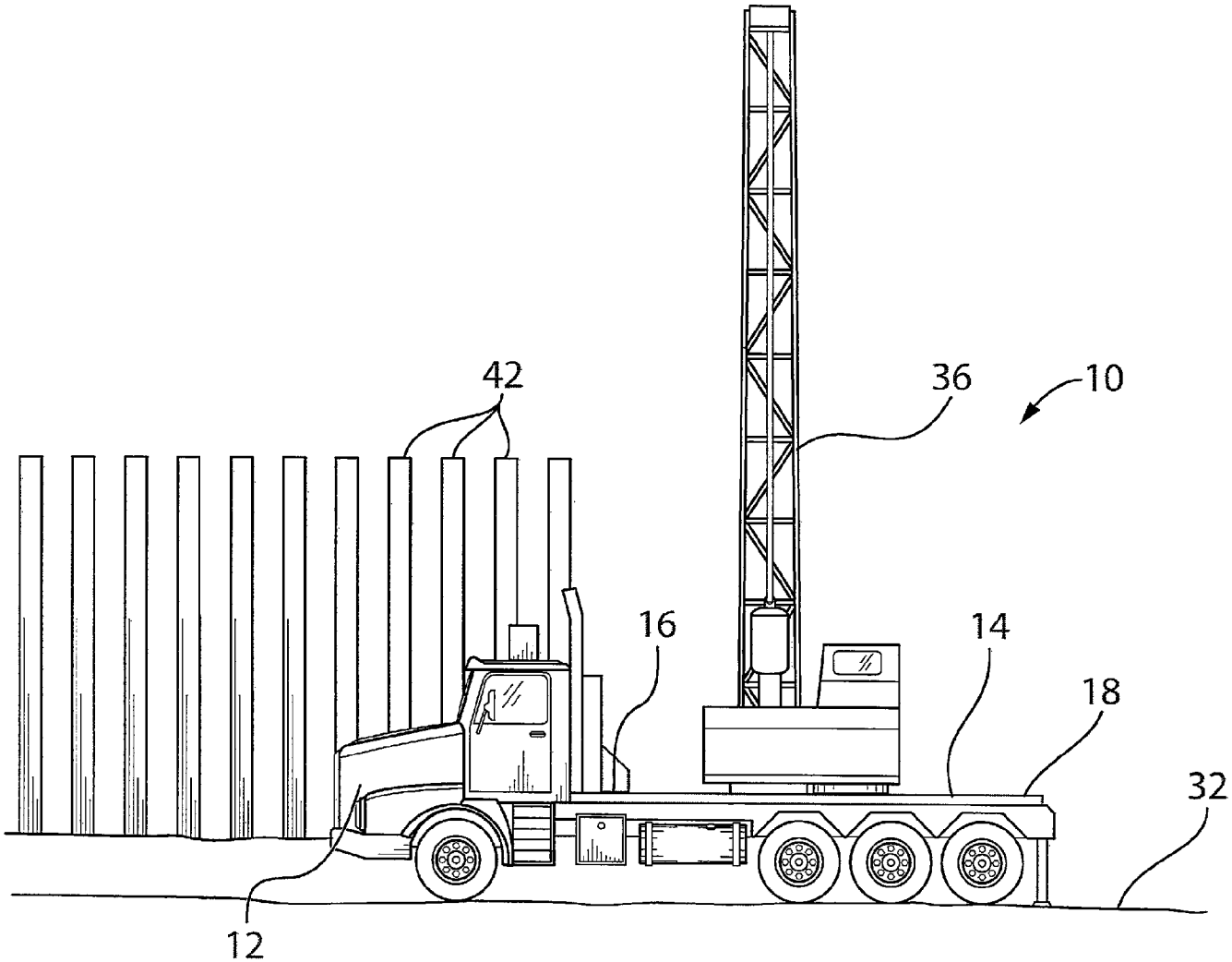
FIG. 4 is a right side elevation view of vehicle with platform moved forward.

By way of example, FIG. 1 and FIG. 2 show platform 14 positioned toward rear 18 of vehicle 12. FIG. 4 shows platform 14 positioned more centrally on vehicle 12. A hydraulic cylinder (not shown) is used to move platform 14 to a selected position along vehicle 12.

Figure 6:
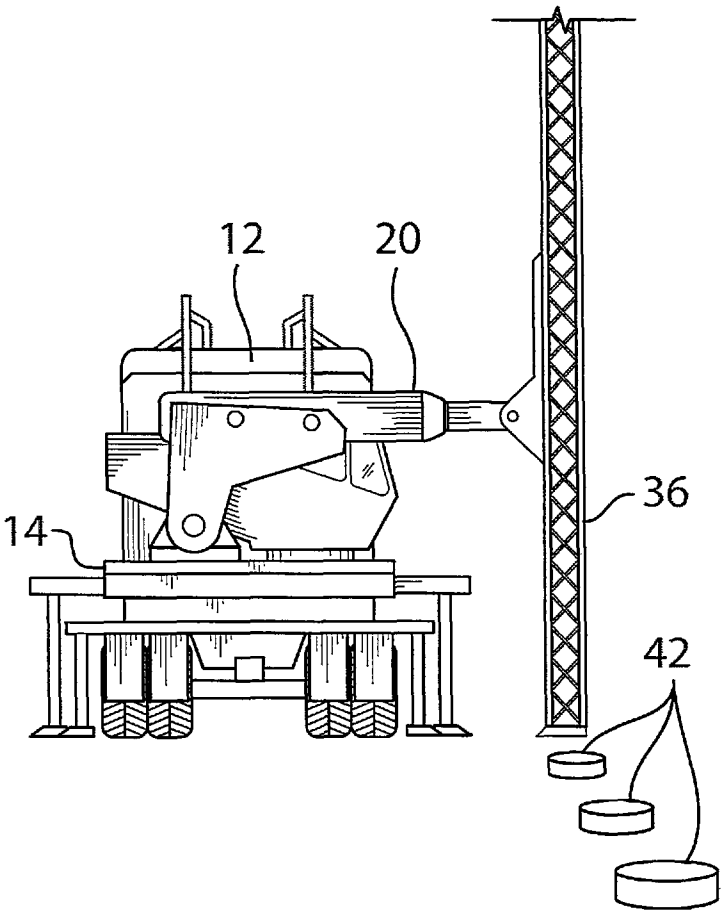
FIG. 6 is a rear elevation view with arm rotated to left of vehicle.
Figure 5:
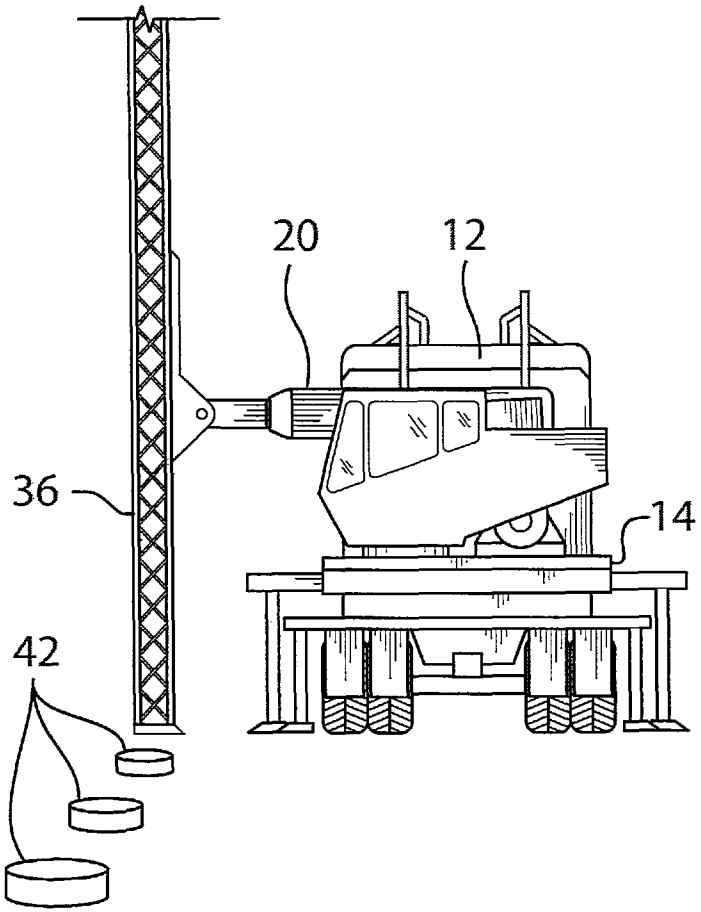
FIG. 5 is a rear elevation view with arm rotated to right of vehicle.
Figure 7:
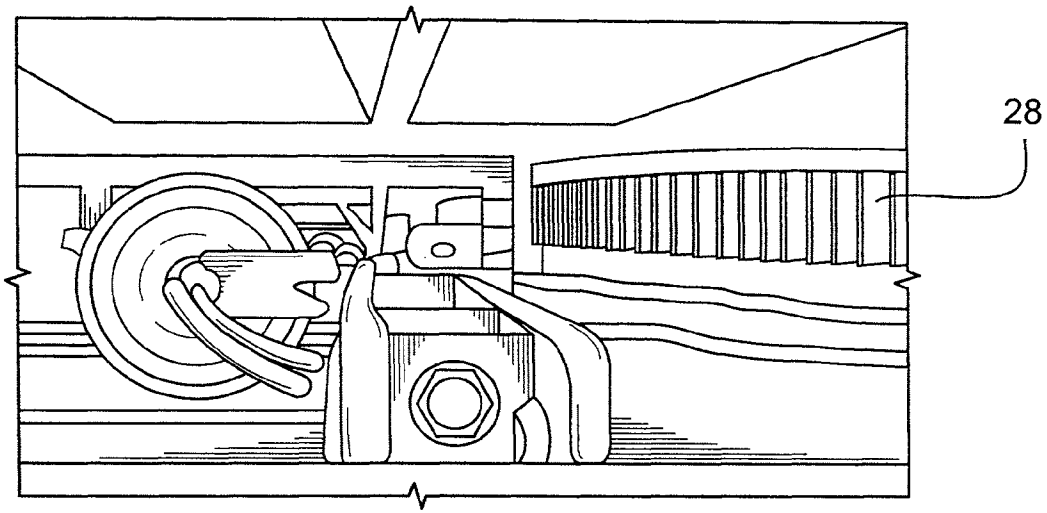
FIG. 7 is a detailed view showing gear assembly for rotation of arm.
Figure 8:
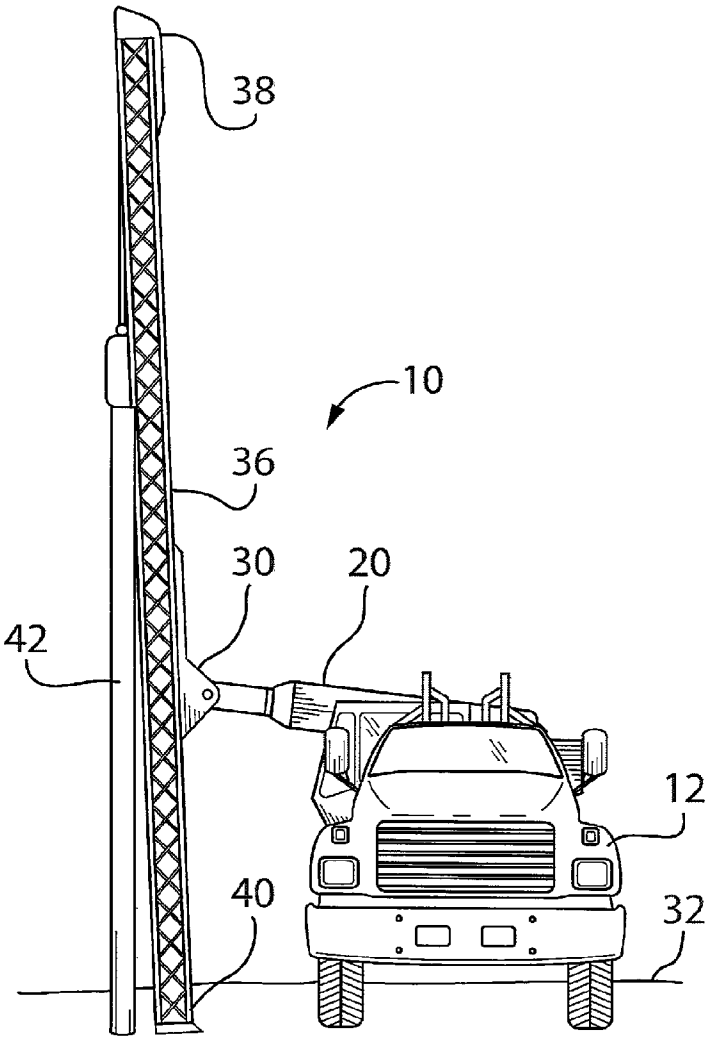
FIG. 8 is a front elevation view with pile driver supported to left side of vehicle.

Referring to FIG. 1, a lifting and positioning arm 20 is provided having a mounting end 22 and a remote end 24. Mounting end 22 is mounted to platform 14. Referring to FIG. 5 and FIG. 6, arm 20 is capable of being rotated about a vertical axis 26 relative to platform 14 wherein remote end 24 of arm 20 is positioned in a selected radial orientation relative to platform 14. Arm 20 can rotate to the left in as shown in FIG. 5 and to the right as shown in FIG. 6. Referring to FIG. 7, a large gear 28 is illustrated that facilitates incremental rotation of the arm 20.

Referring to FIG. 1, arm pivots about a substantially horizontal axis 30 relative to platform 14 wherein arm 20 can be moved up and down. This allows remote end 24 of arm 20 to be positioned at a selected height above grade 32, below grade 32 or at various positions in between. FIG. 1 and FIG. 2 demonstrate this feature in a below grade pile driving application.

Arm 20 is capable of telescopically extending and retracting. This allows remote end 24 of arm 20 to be positioned a selected distance from platform 14. FIG. 1 and FIG. 2 demonstrate this feature in an application in which arm 20 is required to extend in order to reach to below grade 32.

Figure 9:
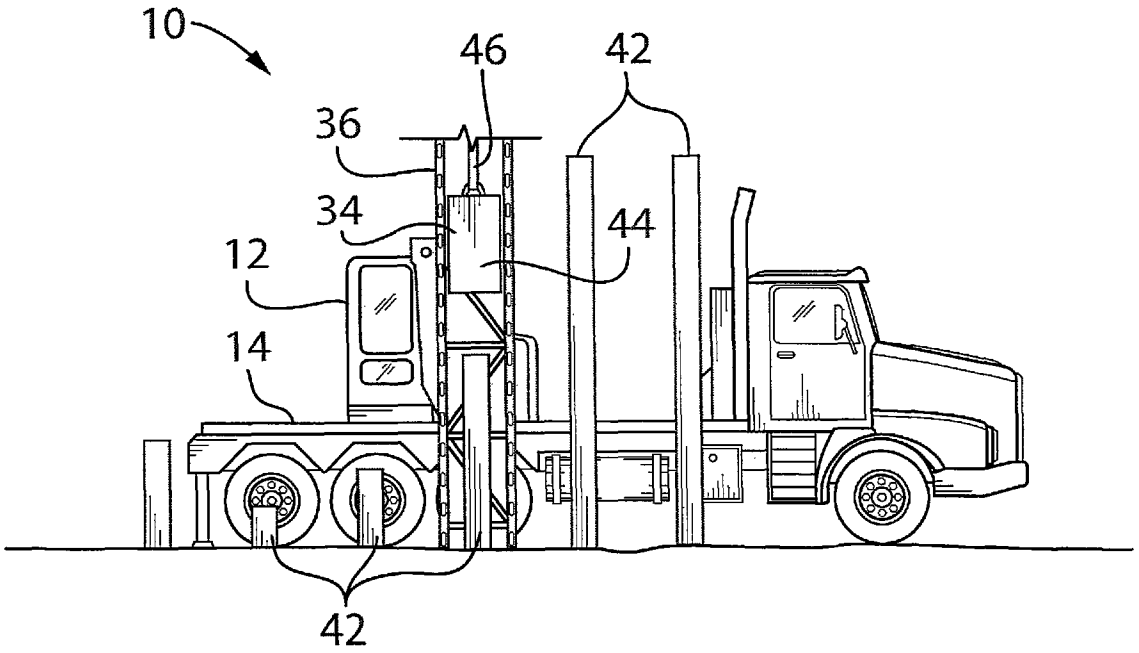
FIG. 9 is a left side elevation view with arm and pile driver positioned on left side.

As can be seen in FIG. 9, a pile driver 34 is provided having a leed assembly 36 with a top end 38 and a bottom end 40. Pile driver 34 is pivotally mounted to remote end 24 of arm 20 toward bottom end 40 of leed assembly 36.

Referring to FIG. 9, a hammer 38, cable 40 and detail of pile driver 34 are illustrated.

Figure 10:
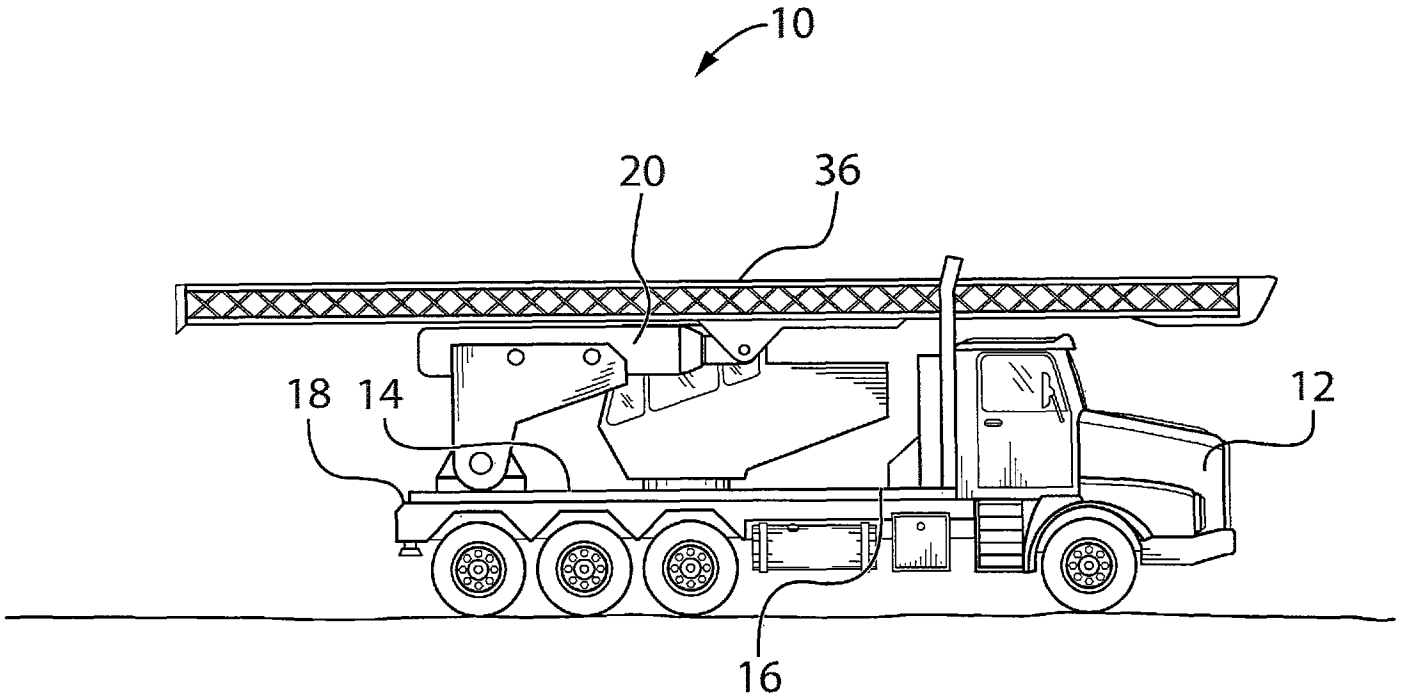
FIG. 10 is a left side elevation view with the platform in position for transport.

Pile driver 34 has an operative position and a transport position. The operative position has been illustrated in FIG. 8. The transport position is illustrated in FIG. 10, which shows the left side elevation view with platform 14 in position for transport Referring to FIG. 10, in the transport position, leed assembly 36 is position in a horizontal position axially over vehicle 12 with platform 14 moved to a selected position relative to vehicle 12 to accommodate the transport position.

Figure 11:
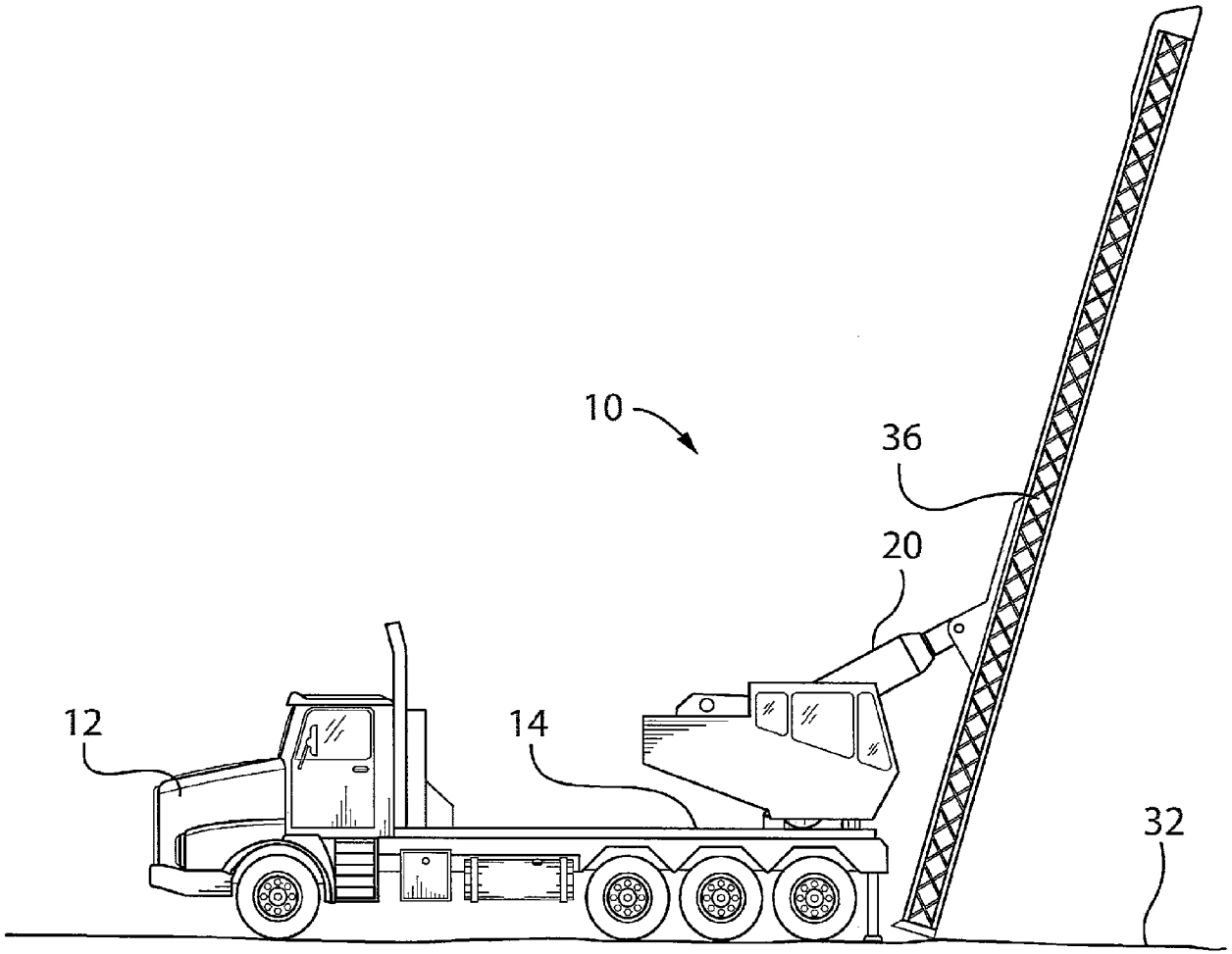
FIG. 11 is a right side elevation view of vehicle pile driver supported at an angle.
Figure 12:
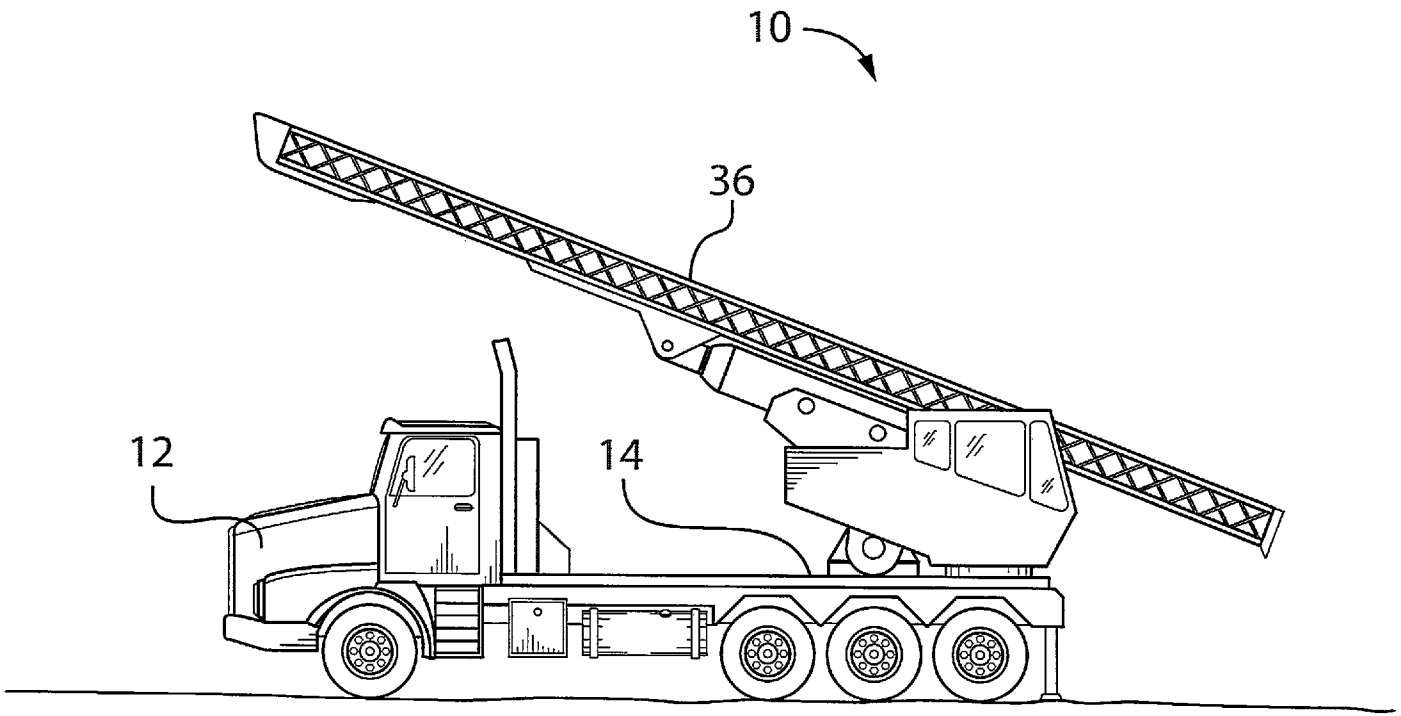
FIG. 12 is a right side elevation view of vehicle pile driver supported at a different angle.

From the foregoing, it can be seen how a number of pilings 42 can be driven into the ground without moving vehicle 12. Piles can be driven to the left and to the right of the vehicle by rotating arm 20, as illustrated in FIG. 5 and FIG. 6. Referring to FIG. 4, by extending the arm, several pilings 42 can be driven sequentially along a line of extension. By extending platform 14 to rear 18 of vehicle 12, as illustrated in FIG. 1 and FIG. 2, the reach of arm 20 can be further extended. Arm 20 can be raised and lowered to accommodate applications that other pile driving apparatus are incapable of handling, such as the below grade applications illustrated in FIG. 1 and FIG. 2. It is also possible to drive pilings at an angle by simply controlling the angle of the leed assembly as shown in FIG. 11 and FIG. 12. It will be appreciated that leed assembly 36 can be positioned at any desired angle, including horizontal as illustrated in FIG. 10.

The apparatus can also be positioned for use at various angles as illustrated in the FIG. 11 and FIG. 12 below. This is something that most pile driving apparatus are incapable of doing.

Referring to FIG. 11 there is illustrated a right side elevation view of vehicle pile driver 10 supported at an angle and FIG. 12 illustrates right side elevation view of vehicle pile driver 10 supported at a different angle.

Variations:

It will be apparent to one skilled in the art that the teachings described above can be applied to the following applications:

Steel Sheet Piling
H Bearing Piling
Steel Pipe Piling
Drilled CIP Concrete Piling
Driven Steel & Timber Piling
Expanded Base Piling
Continuous Flight Auger Piling
Micropiling
Screw Piling
Shoring
Cofferdams
Sound Barrier Walls
Foundation Piers—Short Auger and Down Hole Hammer Applications
Pre-drilling/Shoring—Short Auger and Down Hole Hammer Applications
Communication Towers
Tie-Backs—Short Auger, Continuous Flight, and Down Hole Hammer Applications
Soil Nails
Helical Anchors
Blast Holes
Auger-Cast Piles
De-Watering/Well Points
Water wells Further Features:

Vehicle 12 can include a hitch to enable the unit to tow its own trailer with a load of pilings. The operation of the boom is such that the unit is able to install pick pilings off the trailer and install them without unhitching the trailer.

Outriggers are used to tilt the lead system from side to side for alignment. The outriggers are controlled by remote control to make this process easier.

A 400 amp welder is used to run the entire hydraulic system. The welder provides 220 volt and 110 volt power. The welder also provides the ability to plug the vehicle in to a power outlet (when available) to minimize fuel consumption and green house gases. It also has the ability to run in remote areas for extended periods of time.

The power system has the ability to tilt the lead up and down and from 0 to 140 degrees. This facilitates driving piles at an angle.

The ability to transfer the hammer from front to back of the lead when in transport mode, allows the unit to adjust axle weight to comply with rules and regulations for the different jurisdictions.

There is an ability to drive the self propelled unit from inside the pile driver cab and not just from in side the self propelled vehicle itself. This enables the unit to move down a line setting pilings. as it goes.

There is an ability to slide along frame of unit and swing at the same time, to align the lead with the piles and to reach around fences and other obstacles.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. An apparatus for driving piles or drilling holes, comprising:

a self propelled vehicle having a front and a rear;

a mounting platform supported by the vehicle;

a rigid telescoping lifting and positioning arm having a mounting end and a remote end, the mounting end being secured to a rotating pivot mounted directly to the platform, the rotating pivot defining a vertical axis and the mounting end of the arm being rotated about the vertical axis relative to the platform, wherein the remote end of the arm is positioned in a selected radial orientation relative to the platform, the mounting end of the arm pivoting about a substantially horizontal axis, positioned on the rotating pivot above and closely spaced to the platform, the arm is moved up and down to position the remote end of the arm at a selected height above or below the platform, and, the arm extendible and retractable for positioning the remote end of the arm at a selected distance from the platform; and one of a pile driver or drill assembly is pivotally mounted to the remote end of the arm.

2. The apparatus of claim 1, wherein the platform is movable along the vehicle toward the front and toward the rear, the platform is selectively positioned on the vehicle, movement of the platform altering the positioning of the vertical axis and the horizontal pivot axis of the mounting end of the arm toward the front or toward the rear of the vehicle.

3. The apparatus of claim 1, wherein the pile driver has a leed assembly with a top end and a bottom end and the pile driver is pivotally mounted to the remote end of the arm toward the bottom of the leed assembly.

4. A pile driving apparatus, comprising:

a self propelled vehicle having a front and a rear;

a mounting platform supported by the vehicle, the platform is movable along the vehicle toward the first end and toward the second end, wherein the platform is selectively positioned on the vehicle;

a rigid telescoping lifting and positioning arm having a mounting end and a remote end, the mounting end being secured to a rotating pivot mounted directly to the platform, the rotating pivot defining a vertical axis, the mounting end of the arm being rotated about the vertical axis relative to the platform, the remote end of the arm is positioned in a selected radial orientation relative to the platform, the mounting end of the arm pivoting about a substantially horizontal axis which is positioned on the rotating pivot above and closely spaced to the platform, the arm is moved up and down to position the remote end of the arm at a selected height above or below the platform, and the arm is extendible and retractable, wherein movement of the platform altering the positioning of the vertical axis and the horizontal axis of the mounting end of the arm either toward the front or toward the rear of the vehicle; and a pile driver having a leed assembly with a top end and a bottom end, the pile driver being pivotally mounted to the remote end of the arm toward the bottom of the leed assembly, the pile driver having an operative position and a transport position, in the transport position the leed assembly is positioned in a horizontal position axially over the vehicle with the platform moved to a selected position relative to the vehicle to effect movement of the vertical pivot axis and the horizontal axis to accommodate the transport position.

5. An apparatus for driving piles or drilling holes, the apparatus comprising:

a self propelled vehicle having a front and a rear;

a movable mounting platform supported by the vehicle, and the mounting platform having a rotating pivot which defines a vertical axis; and a rigid telescoping lifting and positioning arm having a mounting end and a remote end, and the mounting end being secured to the rotating pivot so that the lifting and positioning arm being rotatable, relative to the platform, about the vertical axis defined thereby;

wherein the remote end of the arm is positionable at a selected radial orientation relative to the platform, the mounting end of the arm pivoting about a substantially horizontal axis positioned on the rotating pivot located above and closely adjacent to the platform, the arm is movable up and down for positioning the remote end of the arm at a selected height above or below the platform, and the arm is extendable and retractable for positioning the remote end of the arm at a selected distance away from the platform; and one of a pile driver or drill assembly is pivotally mounted to the remote end of the arm.

* * * * *